United States Patent [19]

Taylor

[11] Patent Number: 4,812,317

[45] Date of Patent: Mar. 14, 1989

[54] TRANSPARENT WINE BOTTLE CLOSURE AND CORK

[76] Inventor: Walter S. Taylor, Greyton H. Taylor Memorial Dr., Hammondsport, N.Y. 14840

[21] Appl. No.: 133,332

[22] Filed: Dec. 15, 1987

[51] Int. Cl.[4] ..... B65D 51/18

[52] U.S. Cl. ..... 426/87; 215/230; 426/106; 426/118

[58] Field of Search ..... 426/87, 118, 106, 131; 215/230, 366, 365, 246; 206/459

[56] References Cited

U.S. PATENT DOCUMENTS 2,141,722 12/1938 Morgan ..... 215/246 X 2,863,582 12/1958 Owens ..... 215/230

3,559,834 2/1971 Taylor ..... 426/118

*Primary Examiner*—Donald F. Norton

*Attorney, Agent, or Firm*—Lucas Albright Penrose; Robert A. Miller

[57] ABSTRACT

An outer capsule on a transparent, glass bottle of wine that has been sealed with a cork, the capsule being of a clear, see-through material such as clear, transparent plastic, in position where after being sealably engaged around the exterior neck of the bottle, inspectors and workers at a winery, wine merchants, waiters, shoppers, purchasers and ultimate consumers are able to view the condition of the cork and material adhering thereto, and to identify any commercial message, brand name, trademark, or other information imprinted on the exterior of the cork through the see-through material.

14 Claims, 1 Drawing Sheet

TRANSPARENT WINE BOTTLE CLOSURE AND CORK

BACKGROUND OF THE INVENTION

Field of the Invention

This invention relates to wine bottles and wine corks closures over the bottles' openings, necks and corks contained within the bottles. More particularly, the present invention relates to a wine bottle cork closure, neck wrap or capsule which is constructed of clear transparent plastic or the like material, so that the cork is visible within the neck of the bottle when purchased by the consumer.

It is quite well known for the higher quality of wines, that the wine bottles have extended neck portions with an openings therein wherein corks are compressed and inserted to form liquid tight seals. In addition to the cork contained within the neck of the bottle, there is further included a plastic or metallic closure, usually tinfoil or aluminum which encases the upper portion of the neck portion and provides a secondary sealing member around the exterior of the neck of the bottle, and over the neck of the bottle with the cork thereon to prevent contamination of the wine, and to provide an attractive housing around the opening of the bottle and often further advertising of the product.

For access to the wine within the bottle, the removable closure must be removed or cut away around the lip of the bottle to expose the top of the cork. The cork is then withdrawn so that the wine may be poured. Wine brand names, trademarks or other information may be imprinted on the undersides of the corks so that when the corks are removed, consumers are assured that the wines within the bottles are processed and sealed under the auspices of the wineries responsible. In addition, the wines' producers can thus further advertise and identify themselves as sources of the wines on the cork walls. Because closures of wine bottles are opaque, messages or advertisments on the corks are not viewed until the corks have been removed from the bottles.

SUMMARY OF THE PRESENT INVENTION

The primary purpose and object of the present invention is to provide an outer closure or capsule on a wine bottle that has been sealed with a cork, which is of a clear transparent material so that a consumer can readily read and identify any commercial message or brand name contained on the exterior of the cork through the capsule. This ensures a consumer can identify through writing, etc., on the wall of the cork the wine's brand name or a commercial message that the winery wishes to convey, without having to first remove the opaque capsule which is presently used in the industry. A further important object of the present invention is to allow the potential purchaser of the wine to inspect the condition of the cork. The purchaser can thus observe if there are any imperfections in the cork which may adversely affect the quality of the wine or if bits of the cork may be broken off and have fallen into the wine giving certain wines a "corky" taste. Also the cork may be discolored which, depending on the type of wine and its best age for consumption, may be a favorable or unfavorable sign. This is particularly important for wines served in restaurants wherein the customers may inspect the wine bottles prior to being uncorked. Cases are known wherein wine bottles have been served without having a cork inserted therein and its absence was obscured by a plastic opaque closure.

The inventor's wine is clarified naturally by settling and being decanted in the winter following cooling by exposure to upper New York state seasonal temperatures. However, many commercial wines are clarified by ion-exchange techniques which sodium ions are exchanged to remove potassium ions in the wine, the sodium salts being soluable. But because the inventor's wines are clarified without ion exchange, crystals of potassium bitartrate may be found on the bottom of his corks. The transparent closure thus permits customers and potential customers to appreciate that the inventor's wine has been producted naturally and without being subjected to ion exchange. Moreover, the crystals are a sign of fine quality wines.

Although the primary object of the present invention is to provide a wine bottle capsule as summarized above, other objects, adaptabilities and capabilities of the invention will appear as the description progresses, reference being had to the accompanying drawings, in which:

DETAILED DESCRIPTION OF THE PREFERRED EMBODIMENTS

Figure 1:
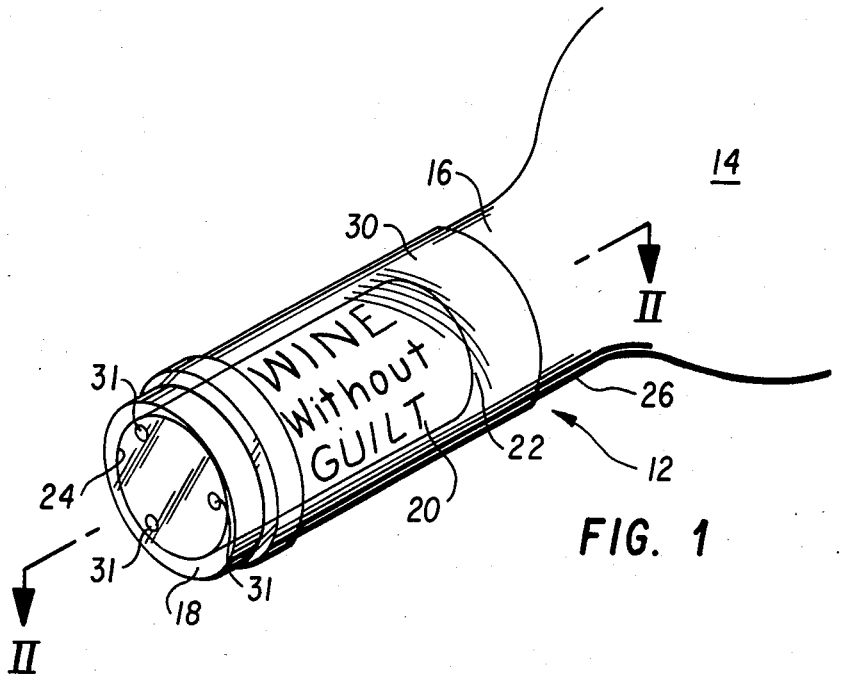
FIG. 1 is a perspective view of the clear capsule engaged around the neck of a wine bottle.
Figure 2:
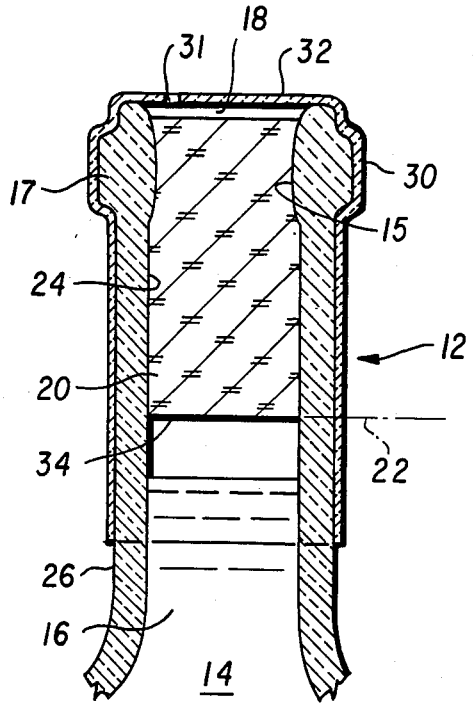
FIG. 2 is a sectional view of the wine bottle capsule shown in FIG. 1 taken along section lines II—II.

FIGS. 1 and 2 are directed to the commercial embodiment of the present invention. An important aspect of the invention concerns the transparent closure or capsule which enables markings on the cork to be identified while it is in place within the neck of the bottle's neck wrap. Further, one can see whether or not the cork is defective and can judge the quality of the wine by discloration of the cork (or lack thereof) and by the presence of natural potassium crystals.

Referring now to FIGS. 1 and 2, there is illustrated a wine bottle 12 having a body portion 14 and an extended neck or throat portion 16 with an opening or mouth 18. This, of course, represents a known type of typical wine bottle available to the industry under various brand names. It is important, however, that portion 16 be sufficiently transparent so that the cork 20 therein can be viewed clearly and without undue distortion from the outside.

For purposes of illustration, wine bottle 12 represents a wine bottle containing wine produced by the inventor to be sold to consumers. Included within neck portion 16 is cork 20 which is a typical type of cork inserted through mouth portion 18 to a certain desired depth 22 within neck portion 16 so that the upper end of cork 20 is substantially flush with mouth 18 of bottle 12. Cork 20 is then in lateral compression and its exterior sealably engaged between the inner wall surfaces 24 of neck portion 16, so that wine may not escape through the neck portion. However, as is well known in the wine industry, cork 20 permits the wine to breathe whereby there is a slow diffusion of gaseous fluids taking place through the body of the cork between the opening and interior of bottle 12. Cork 20, when inserted in neck portion 16, has its original diameter compressed about twenty-five percent.

As seen further in FIG. 2, the typical wine bottle's neck portion 16 further includes an upper flange or collar portion 17 adjacent mouth 18 which serves as a means for gripping the neck portion 16, to facilitate handling of the wine bottle 12 without the bottle slipping through one's grasp, and to strengthen the bottle structurally. The bottle is also strengthened structurally by the interior flange 15 which further retains the compressed cork 20 in place, once inserted, until removed by a corkscrew.

As further seen in FIGS. 1 and 2, to provide further sealing of wine bottle 12, and to prssent a commercially appealable product, mouth 18 and upper portion of neck portion 16 is encased in a continuous closure of capsule 30 which is snuggly fitted against the outer wall 26 of neck portion 16. As seen clearly in cross-sectional view in FIG. 2, capsule 30 provides a form-fitting a protective seal around the exterior of the neck portion including flange portion 17. The application of capsule 30 around neck portion 16 may be accomplished through a known heat sealing or the like processes. Capsule 30 is intentionally perforated in the vicinity of mouth 18 or composed of a material which permits gaseous diffusion therethrough so that wine within bottle 12 is permitted to breathe. In the embodiment shown, capsule 30 is provided with three perforations 31, each onesixteenth of an inch in diameter spaced 120 degrees apart around the upper part 32 of capsule 30.

Typically, in the art, capsule 30 is opaque and serves as a means for attractively sealing the end of the bottle.

However, in the present invention capsule 30 is constructed of a transparent material such as plastic, or the like, so that a purchaser or consumer, upon viewing bottle 12, can view the interior cork member 20 within neck portion 16. He is thus assured that the cork contained within bottle 12 is properly secured and, as seen in FIG. 1, the winery is enabled to present a commercial message to the consumer as the cork is being viewed. For example in FIG. 1, there is a message "Wine Without Guilt", which serves as an example of a message a winery may wish to convey. For "Wine Without Guilt", attention is invited to U.S. Pat. Nos. 1,137,952 of Sept. 30, 1980, and 1,142,817 of Dec. 9, 1980, for wine corks and wine, respectively, of the inventor's winery, Bully Hill Vineyards, Inc. Further, the manufacturer of the cork or the winery may want to place its name or trademark on the cork, to serve as an identify of source on the exterior of the cork which can be visually inspected through the glass of the neck 16 and the transparent capsule 30 therearound including crystals of potassium bitartrate which may be formed at the bottom 34 of cork 20.

Another function of the invention is to inform the winery whether or not the desired compression of each cork exists by knowing how the printed material should appear when the desired compression of the cork in the wine bottle is achieved. If the cork is over-compressed, the letters tends to be squat and it is likely the cork will be difficult to remove without causing it to break. Also, diffusion through the cork may be hampered so the wine does not "breathe" as it should. If the printing on the cork is unduly elongated in height, the seal may be less than adequate. For this reason, test corks may have circular, rectangular, etc., grids printed thereon which are used to ensure that the bottles and the corks are correct matches. Incidentally, the patterns printed on the corks may be prepared to cooperate with laser scanning devices for quality control and identification purposes.

It will be evident to those skilled in the art that the drawings in the FIGS. 1 and 2 have, insofar as practical, been drawn to scale. In practice, however, neck portion 16 is slightly flared as it extends downwardly as exists in most commercial wine bottles.

Although I have disclosed the perferred embodiment of my invention in the foregoing specification and drawings, it is to be understood that the inventive concepts incorporated therein may be embodied in other adaptations and modifications within the scope of the claims.

Having described my invention, what I claim as new and to be secured by Latters Patent of the U.S. is:

1. A housing encasing the mouth and neck portion of a wine bottle of the type having a cork that is in a state of compression inserted within said neck portion, the housing comprising a flexible and readily removable clear transparent capsule around said neck portion and over the cork opening therein, the portion of said clear transparent capsule over the cork opening having a perforation of sufficient size to permit the wine to breathe and said capsule and said neck portion each being sufficiently transparent so that the entire cork, including its lower end, can be viewed without undue distortion within said neck portion without removing the capsule therefrom.

2. The capsule in accordance with claim 1, wherein the capsule is constructed of clear plastic or the like material.

3. The capsule in accordance with claim 1, wherein the capsule is snuggly fitted to said neck portion to facilitate the viewing of markings, contained on the cork and the condition of the cork.

4. An improved sealing member for wine bottles of the type having an elongated neck portion with an opening at the end thereof, the sealing member comprising:

a. a cork which is compressible and insertable in solid compressed state into said opening and information being imprinted on the wall of said cork; and b. a transparent capsule arranged around said neck portion and said opening of the wine bottle, said capsule allowing said information on said cork to be viewed and readily read from the outside through said capsule.

5. The sealing member in accordance with claim 4, wherein said information comprises a message on said cork which may be words or other symbols.

6. The sealing member in accordance with claim 4, wherein said capsule is composed of clear plastic or the like material.

7. The sealing member in accordance with claim 4, wherein said transparent capsule permits the cork to be viewed from anywhere 360 degrees around the exterior of said cork.

8. A closure surrounding the mouth of a wine bottle, of the type having an elongated neck portion with a mouth in the end thereof, and a cork under compression inserted into the mouth of the wine bottle, the cork further including a message printed along the cork wall, the closure comprising a flexible transparent capsule which encases said neck portion and said mouth of the wine bottle, to substantially the length of the cork, the transparent capsule allowing the message on the cork to be viewed while the cork is contained within the neck of the wine bottle without first removing the capsule therefrom.

9. A wine bottle apparatus comprising:

a. a wine bottle having a transparent neck portion ending in a mouth for access to interior of the wine bottle;

b. a compressible cork member insertable within said mouth of the wine bottle, said cork having indicia thereupon; and c. transparent sealing means positionable over said mouth and that portion of said neck portion housing said cork, so that the indicia on said cork can be viewed through the combination of the transparent sealing means and said neck portion of said wine bottle, once said sealing means is in position.

10. Apparatus in accordance with claim 9, wherein said sealing means is constructed of clear plastic or the like material.

11. A bottle containing wine wherein potassium salts have not been removed by ion-exchange methods, the bottle comprising a bottle portion and an elongated generally cylindrical neck portion and an elongated cylindrical cork under compression in said neck portion, a continuous plastic closure over said neck portion and the top of said cork, potassium bitartrate crystals formed on the bottom of said cork in the interior of the bottle, said closure and said neck portion being composed of clear transparent material so that the outer surface of said cork in said neck portion and said potassium bitartrate crystals on the bottom of said cork are readily visible to an observer without the necessity of removing said cork.

12. A bottle of wine according to claim 11, wherein said closure and said neck portion are constructed and arranged so that the condition of substantially all of said cork is visible to an observer of the bottle without removing said cork.

13. A bottle of wine according to claim 12, wherein said cork has indicia imprinted thereon which is clearly visible to an observer of the bottle without removing said cork.

14. A bottle of wine according to claim 11, wherein said closure is composed of a material which is perforated or sufficiently permeable to permit said wine to breathe through said cork.

* * * * *